US007134207B2

(12) United States Patent
Ping

(10) Patent No.: US 7,134,207 B2
(45) Date of Patent: Nov. 14, 2006

(54) FOLDABLE UTILITY KNIFE

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 158 days.

(21) Appl. No.: 10/846,475

(22) Filed: May 14, 2004

(65) Prior Publication Data

US 2004/0226175 A1 Nov. 18, 2004

Related U.S. Application Data

(63) Continuation-in-part of application No. 10/750,134, filed on Dec. 31, 2003, now Pat. No. 6,968,622, which is a continuation-in-part of application No. 10/437,089, filed on May 13, 2003, now Pat. No. 7,040,022.

(51) Int. Cl.
*B26B 1/02* (2006.01)

(52) U.S. Cl. ..... 30/125; 30/153; 30/155; 30/156

(58) Field of Classification Search ..... 30/125, 30/153, 155–157, 161, 330, 331, 334
See application file for complete search history.

(56) References Cited

U.S. PATENT DOCUMENTS

| | | | | |
|---|---|---|---|---|
| 97,154 | A | 11/1869 | Barnard | 7/118 |
| 493,075 | A | 3/1893 | Evertz | 30/32 |
| 515,045 | A | 2/1894 | Bultzingslowen | 297/77 |
| 584,077 | A | 8/1897 | Jackson | 30/161 |
| 596,096 | A | 12/1897 | Watts | 7/118 |
| 988,068 | A | 3/1911 | Beardsley | 30/161 |
| 1,362,142 | A | 12/1920 | Rohrer | 30/161 |
| 1,444,324 | A | 2/1923 | Brooks | 30/156 |
| 1,706,251 | A | 3/1929 | Perry | 30/337 |
| 1,750,577 | A | 3/1930 | DeBracht | 30/295 |
| 2,134,973 | A | 11/1938 | Harwell | 30/156 |
| 2,265,775 | A | 12/1941 | Mc Namara | 30/156 |
| 2,284,128 | A | 5/1942 | Bush | 30/335 |
| 2,523,575 | A | 9/1950 | Kassel | 30/156 |
| 2,914,850 | A | 12/1959 | Kuhnl | 30/156 |
| 2,980,996 | A | 4/1961 | Beran | 30/157 |
| 3,306,297 | A | 2/1967 | Voorhees | 128/207.29 |
| 3,568,315 | A | 3/1971 | Smith | 30/161 |
| 3,593,417 | A | 7/1971 | West | 30/125 |
| 3,872,591 | A | 3/1975 | Quenot | 30/162 |
| 4,017,969 | A | 4/1977 | Stonebraker | 30/156 |
| 4,040,181 | A | 8/1977 | Johnson | 30/161 |
| 4,261,104 | A | 4/1981 | Cuscovitch | 30/330 |
| 4,347,665 | A | 9/1982 | Glesser | 30/161 |
| 4,442,600 | A | 4/1984 | Felix-Salichow | 30/161 |
| 4,570,341 | A | 2/1986 | Konneker | 30/161 |
| 4,604,805 | A | 8/1986 | Krieger | 30/330 |
| 4,665,615 | A | 5/1987 | Martinez | 30/53 |

(Continued)

FOREIGN PATENT DOCUMENTS

| | | |
|---|---|---|
| CN | 02-2-88379.7 | 12/2002 |

(Continued)

*Primary Examiner*—Boyer D. Ashley
*Assistant Examiner*—Carolyn Blake
(74) *Attorney, Agent, or Firm*—Joseph J. Previto

(57) ABSTRACT

A utility knife having a handle and a blade holder movably mounted on the handle for movement from an unfolded position to a folded position. The handle has a space adapted to receive the blade holder when the blade holder is in its folded position. The blade holder has a blade holder mechanism thereon and a finger support. The handle also has a blade storage compartment.

40 Claims, 7 Drawing Sheets

U.S. PATENT DOCUMENTS

| | | | | |
|---|---|---|---|---|
| 4,669,188 | A | 6/1987 | Evrell | 30/161 |
| 4,719,700 | A | 1/1988 | Taylor, Jr. | 30/158 |
| 4,805,303 | A | 2/1989 | Gibbs | 30/161 |
| 4,811,486 | A | 3/1989 | Cunningham | 30/161 |
| 4,920,644 | A | 5/1990 | La Gattuta | 30/53 |
| 4,936,014 | A | 6/1990 | Shaanan et al. | 30/162 |
| 5,044,079 | A | 9/1991 | Gibbs | 30/160 |
| 5,095,624 | A | 3/1992 | Ennis | 30/161 |
| 5,125,157 | A | 6/1992 | Howard | 30/123 |
| 5,400,509 | A | 3/1995 | Collins | 30/161 |
| 5,511,310 | A | 4/1996 | Sessions et al. | 30/161 |
| 5,769,094 | A | 6/1998 | Jenkins, Jr. | 30/161 |
| 5,815,927 | A | 10/1998 | Collins | 30/161 |
| 5,826,340 | A | 10/1998 | Hull | 30/161 |
| 5,909,930 | A | 6/1999 | Ragland, III et al. | 30/125 |
| 5,966,816 | A | 10/1999 | Roberson | 30/156 |
| 5,979,059 | A | 11/1999 | Leatherman et al. | 30/161 |
| 6,134,788 | A * | 10/2000 | Chen et al. | 30/125 |
| 6,170,104 | B1 | 1/2001 | Seber | 7/128 |
| 6,170,158 | B1 | 1/2001 | Daily | 30/161 |
| 6,256,887 | B1 | 7/2001 | Osborne | 30/161 |
| 6,256,888 | B1 | 7/2001 | Shuen | 30/161 |
| 6,263,581 | B1 | 7/2001 | Forte | 30/332 |
| 6,354,007 | B1 | 3/2002 | Scarla | 30/156 |
| 6,370,778 | B1 | 4/2002 | Conable | 30/161 |
| 6,446,341 | B1 | 9/2002 | Wang et al. | 30/125 |
| 6,487,740 | B1 | 12/2002 | Seber et al. | 7/128 |
| 6,513,246 | B1 * | 2/2003 | Ping | 30/125 |
| 6,574,868 | B1 | 6/2003 | Overholt | 30/155 |
| 6,688,003 | B1 | 2/2004 | Scarla | 30/156 |
| D494,437 | S | 8/2004 | Scarla | D8/99 |
| 6,915,577 | B1 | 7/2005 | Scarla | 30/156 |
| 2002/0059730 | A1 | 5/2002 | Flavigny | 30/161 |
| 2004/0020057 | A1 | 2/2004 | Hughes | 30/155 |
| 2004/0045171 | A1 | 3/2004 | Moizis | 30/161 |
| 2004/0103541 | A1 | 6/2004 | Scarla | 30/161 |

FOREIGN PATENT DOCUMENTS

| | | |
|---|---|---|
| CN | 200420008852.7 | 3/2004 |
| CN | 200420008854.6 | 3/2004 |
| CN | 200420020589.3 | 3/2004 |
| CN | 200420020590.6 | 3/2004 |
| CR | 200420020591.0 | 3/2004 |
| WO | WO90086633 | 8/1990 |

* cited by examiner

FOLDABLE UTILITY KNIFE

RELATED APPLICATION

This is a continuation-in-part of U.S. patent application Ser. No. 10/750,134 filed Dec. 31, 2003 now U.S. Pat. No. 6,968,622 which in turn is a continuation-in-part of U.S. patent application Ser. No. 10/437,089 filed May 13, 2003 now U.S. Pat. No. 7,040,022.

BACKGROUND

The present invention relates to a utility knife and more particularly to a foldable utility knife in which the blade may be folded into the handle when the knife is not in use.

Utility knives have been in use for a number of years. Some of these utility knives have blades that are mounted on a blade holder which is foldable within a handle when the knife is not in use. However, some of these utility knives have many movable parts which makes them difficult to use and expensive to manufacture. In some of these utility knives replacement of the blade is a complicated operation which may require the use of special tools. In addition, some existing utility knives do not have means to support a finger when the knife is in use nor do they have adequate means to store extra blades.

OBJECTS

The present invention overcomes these problems and has for one its objects the provision of an improved utility knife in which the blade holder may be easily folded into the handle.

Another object of the present invention is the provision of an improved utility knife in which the blade is held securely on the blade holder.

Another object of the present invention is the provision of an improved utility knife in which improved means are provided for replacing the blade on the blade holder.

Another object of the present invention in the provision of an improved utility knife which has means for storing extra blades therein.

Another object of the present invention is the provision of an improved utility knife which has finger support means.

Another object of the present invention is the provision of an improved utility knife which is simple to use and inexpensive to manufacture and maintain.

Other and further objects of the invention will be obvious upon an understanding of the illustrative embodiment about to described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
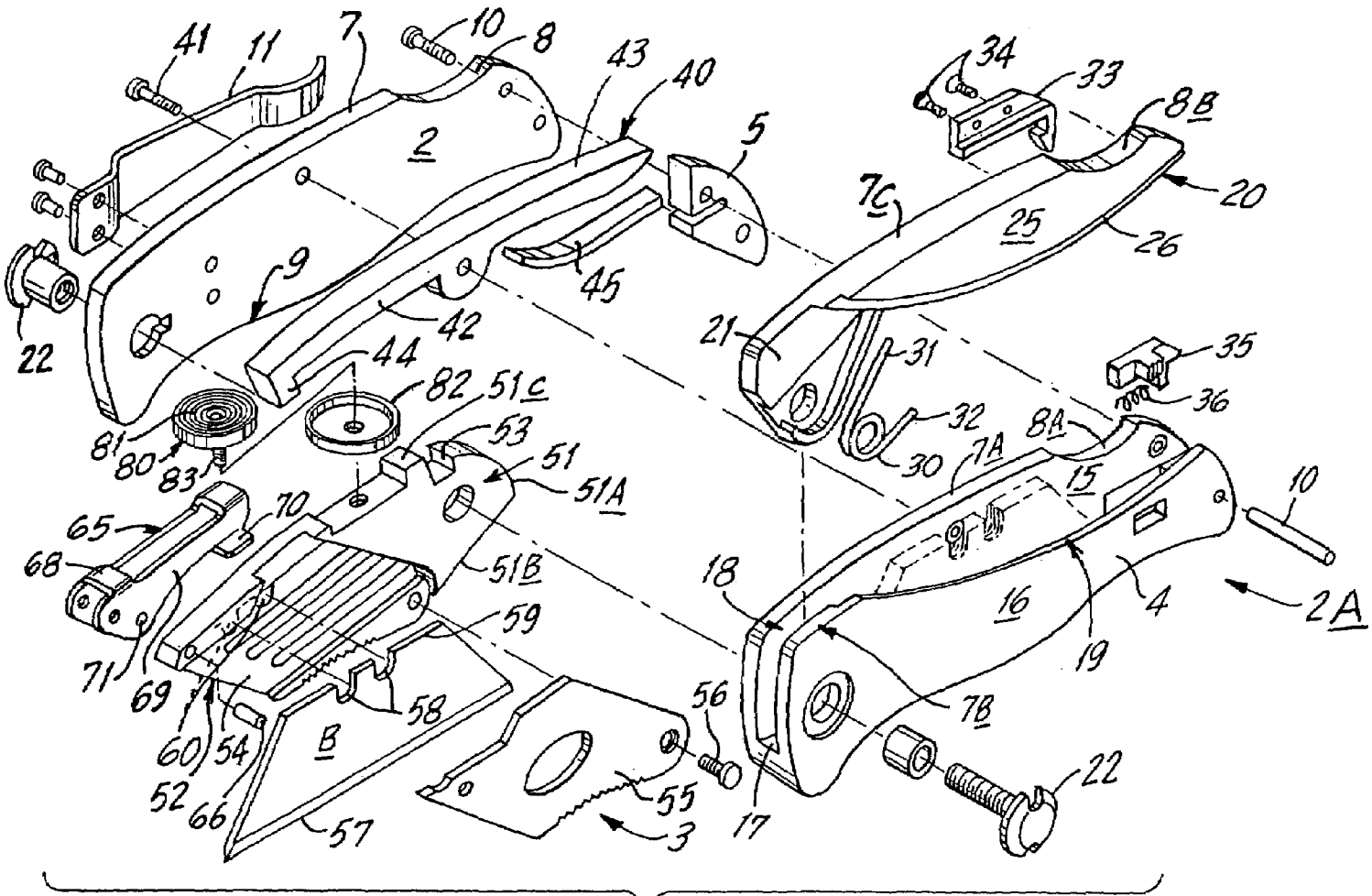
FIG. 1 is an exploded perspective view of a utility knife made in accordance with the present invention.
Figure 2:
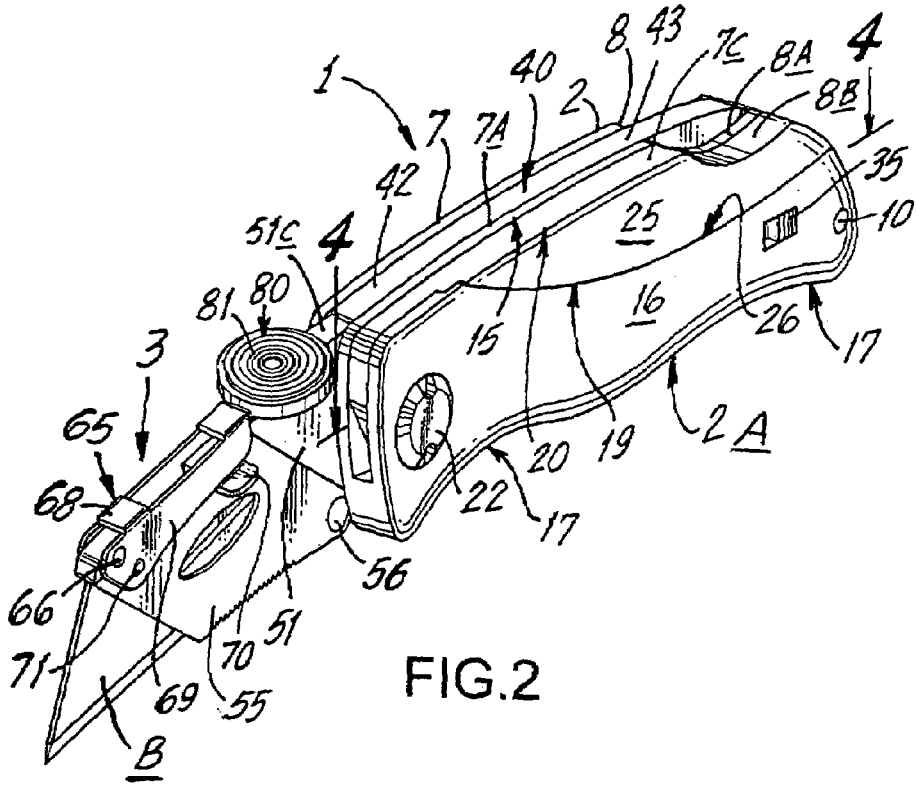
FIG. 2 is a perspective view of the utility knife of the present invention.
Figure 3:
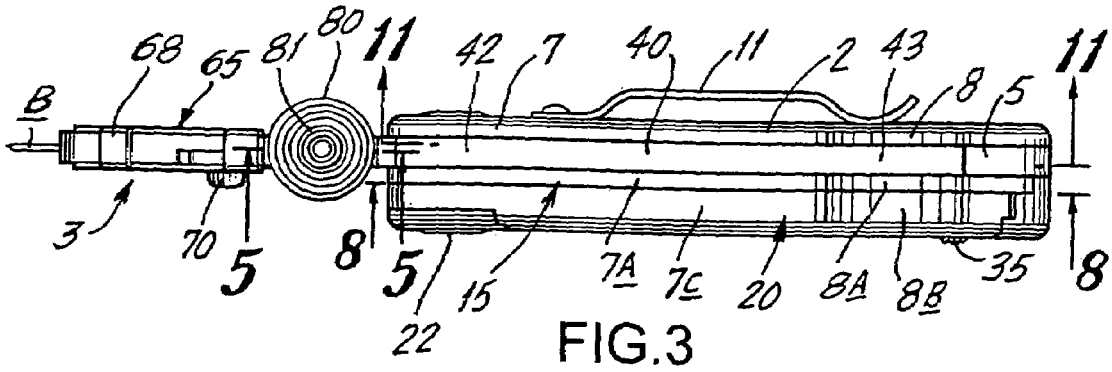
FIG. 3 is a top plan view thereof.

Referring to the drawings, the utility knife 1 of the present invention comprises a handle assembly 2A and a blade holder 3.

Figure 4:
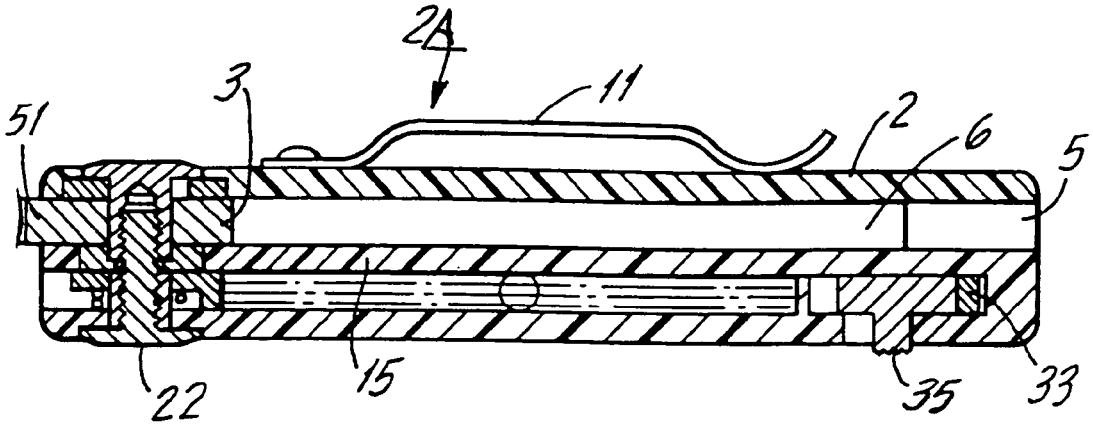
FIG. 4 is a sectional view taken along the line 4—4 of FIG. 2.

The handle assembly 2A comprises a side wall 2 having an upper edge 7 and a lower edge 9. A U-shaped blade storage compartment 4 having an inner wall 15 is provided and attached to the side wall 2 through the intermediation of a spacer 5. The spacer 5 creates a space 6 (FIG. 4) between side wall 2 and the inner wall 15 of the blade storage compartment 4. The spacer 5, the side wall 2 and the blade holding compartment 4 are held together by fasteners 10 which extend through the spacer 5, the side wall 2 and the blade holding compartment 4 in order to hold them together. The upper edge 7 of the side wall 2 has a finger notch 8 therein. The lower edge 9 of the side wall 2 may be undulated in order to form a grip for the user. If desired, a clip 11 may be mounted on the outside of the side wall 2 to permit the utility knife 1 to be fastened onto the user's belt or onto some other convenient place.

The blade holding compartment 4 is u-shaped and has a pair of spaced inner and outer walls 15 and 16, respectively, a bottom wall 17 connecting the inner and outer walls 15–16 together, and an open top 18. The upper edge 7A of the inner wall 15 is shaped similarly to and conforms with the upper edge 7 of the side wall 2 and has a notch 8A therein which preferably conforms in location, size and shape to the notch 8 in the side wall 2. The bottom wall 17 of the blade storage compartment 4 is undulated in manner similar to and conforming to the undulated lower edge 9 of the side wall 2 in order to give the user a good grip on the utility knife. The outer wall 16 has an upper edge 7B having a downwardly curved cut out to form a concave edge portion 19.

The open top 18 of the blade storage compartment 4 is adapted to be closed by a cover assembly 20 having a rear portion 21 which is interposed between and pivotally mounted to the inner and outer walls 15 and 16 by means of a pivot assembly 22. The cover assembly 20 has a top surface 7C and a notch 8B which conform in location, shape and size to the top edges 7 and 7A and the notches 8 and 8A in the side wall 2 and the inner wall 15, respectively. A skirt 25 depends from the top surface 7C and has a lower curved convex edge 26 which conforms to and mates with the concave edge 19 in the outer wall 16 to close the blade storage compartment 4. A spring 30 having diverging arms 31 and 32 is mounted within the blade storage compartment 4 between inner and outer walls 15–16 and around the pivot assembly 22 with its arms 31 and 32 biased outwardly so that the spring 30 will normally raise the cover assembly 20 to open the blade storage compartment 4.

Figure 9:
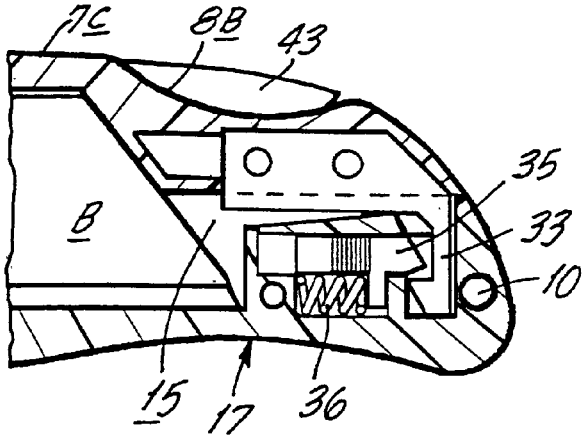
FIG. 9 is an enlarged fragmentary sectional view similar to FIG. 8 showing the storage compartment cover release mechanism in a locked cover closing position.
Figure 10:
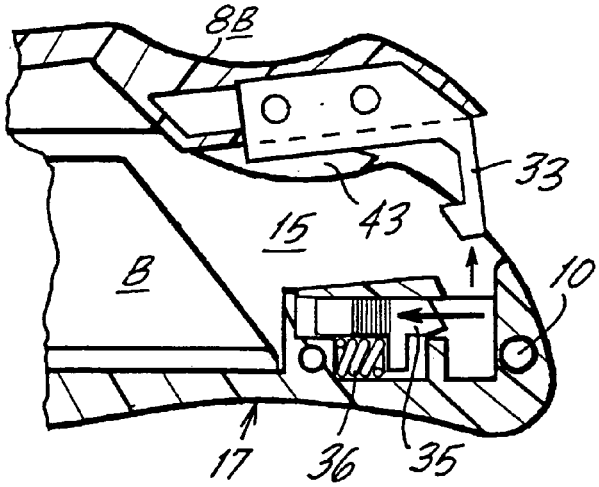
FIG. 10 is an enlarged fragmentary sectional view similar to FIG. 9 showing the storage compartment cover release mechanism in an unlocked cover opening position.

The inner surface of the skirt 25 has a hook 33 mounted thereon by means of fasteners 34. The inner surface of the outer wall 16 has a spring pressed latch 35 mounted thereon which is normally biased toward the rear of the outer wall 16 by means of a spring 36. When the cover assembly 20 is in its closed position, the latch 35 enters the hook 33 to keep the cover in it closed position (FIG. 9). When the latch 35 is moved against the spring 36 it moves out of the hook 33 and the cover assembly 30 will spring up under the influence of the spring 30 to open the blade storage compartment 4. To close the blade storage compartment 4, the cover 20 is moved down against the bias of the spring 30 until the hook 33 snaps under the latch 35 which enters the hook 33 to hold the cover assembly 20 of the storage blade compartment 4 in a closed position.

Figure 8:
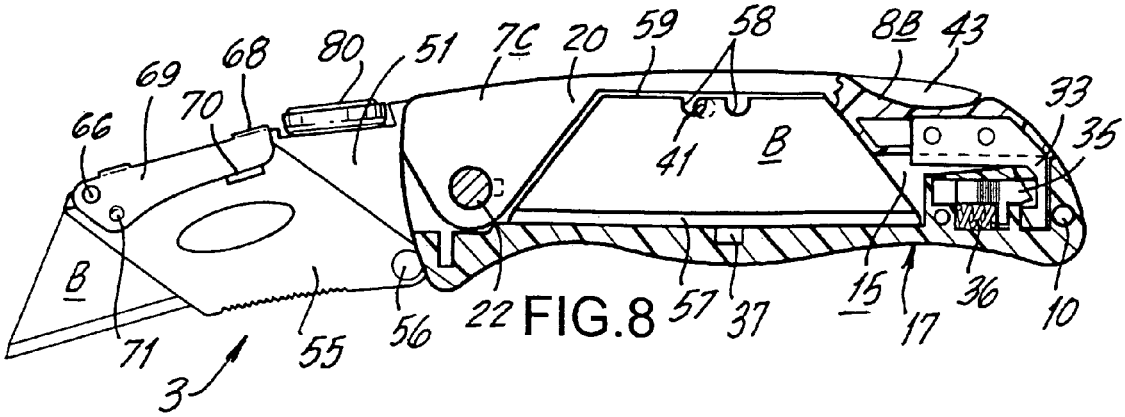
FIG. 8 is a sectional view taken along line 8—8 of FIG. 3.

A plurality of blades B may be stored within the blade storage compartment 4 each of which can then be removed when it is desired to replace an old blade B with a new blade B. In order to prevent the blades B from moving and rattling within the blade storage compartment 4, the bottom wall 17 of the blade storage compartment 4 has a magnet 37 (FIG. 8) mounted therein to magnetically attract the blades B and hold them steady within the blade storage compartment 4.

Mounted in the space 6 formed between the side wall 2 and the inner wall 15 of the blade storage compartment 4 and along their upper edges 7 and 7A there is provided a lock lever assembly 40 which is pivotally mounted between the side wall 2 and the inner wall 15 on a pivot pin 41 which extends through the side wall 2, the inner wall 15 and the lock lever assembly 40. The lock lever assembly 40 is preferably a two arm lever having front and rear arms 42 and 43, respectively. The front arm 42 is provided with a downwardly extending lock finger 44. Below the rear arm 43 of the lock lever assembly 40 there is provided a leaf spring 45 which is mounted on the spacer 5 and which normally bears against the bottom edge of the rear arm 43 to force the rear arm 43 upwardly and the front arm 42 downwardly around the pivot 41 so that rear arm 43 normally protrudes above the notches 8, 8A and 8B in the side wall 2, inner wall 15 and top edge 7C, respectively. It will be seen that when the rear arm 43 of the lock lever assembly 40 is pressed down manually at the notches 8, 8A and 8B against the action of spring 45, the front arm 42 will be raised together with its lock finger 44.

The blade holder 3 of the present invention comprises a rear end 51 and a front end 52 which are preferably integral with each other. The blade holder 3 has a rear edge 51A, a bottom edge 51B and an upper edge 51C. The blade holder 3 is pivotally mounted in the space 6 between side wall 2 and inner wall 15 on the pivot pin assembly 22. The upper edge 51C has a groove 53 therein into which the downwardly extending lock finger 44 of the lock assembly 40 is adapted to enter when the blade holder 3 is in its extended or unfolded position.

The front end 52 of the blade holder 3 comprises a thin main wall 54 and a thin guard wall 55 pivotally mounted on the main wall 54 on pivot pin 56. The main wall 54 is adapted to hold a blade B which comprises a lower cutting edge 57 and spaced notches 58 in its upper edge 59. The main wall 54 has a pair of spaced protrusions 60 extending therefrom into which the upper notches 58 of the blade B are adapted to enter to hold the blade B in place on the main wall 54. It will be seen that when the guard wall 55 is in its closed raised position it covers and holds the blade B in place but when it is in its open downward position, it exposes the blade B.

Figure 13:
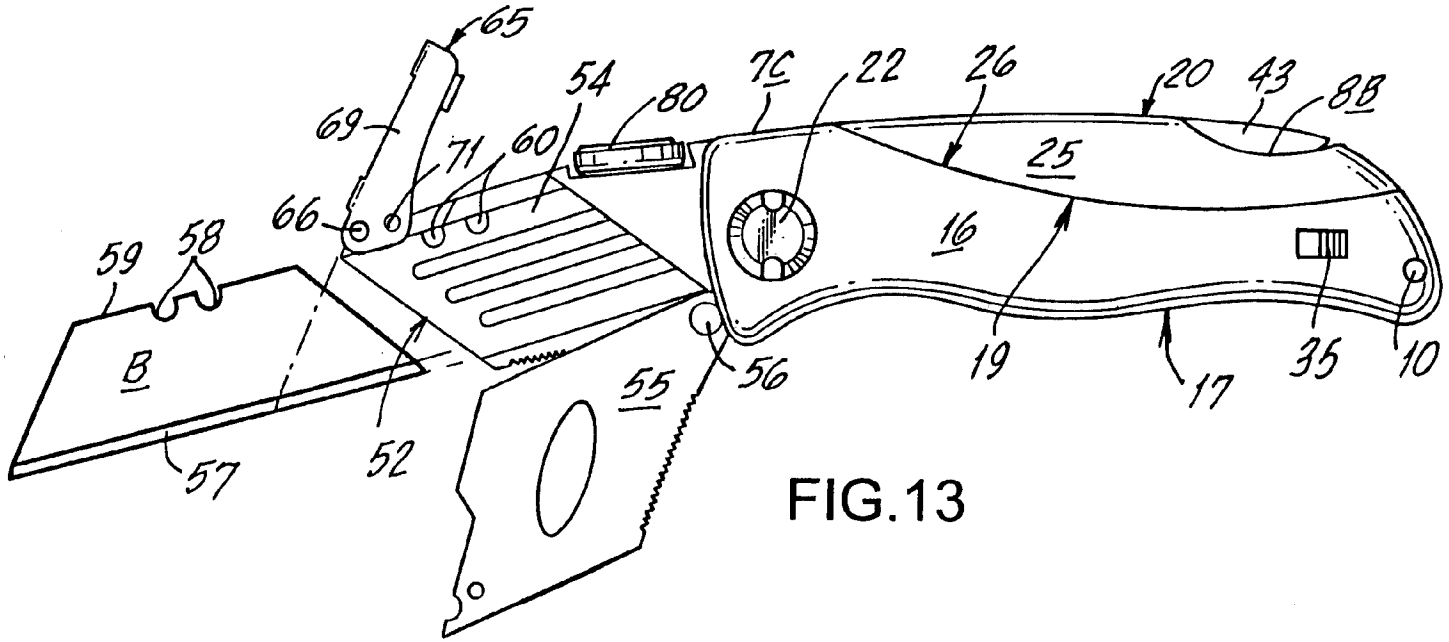
FIG. 13 is a plan view of one side of the utility knife showing the manner of removing and replacing the blade.
Figure 14:
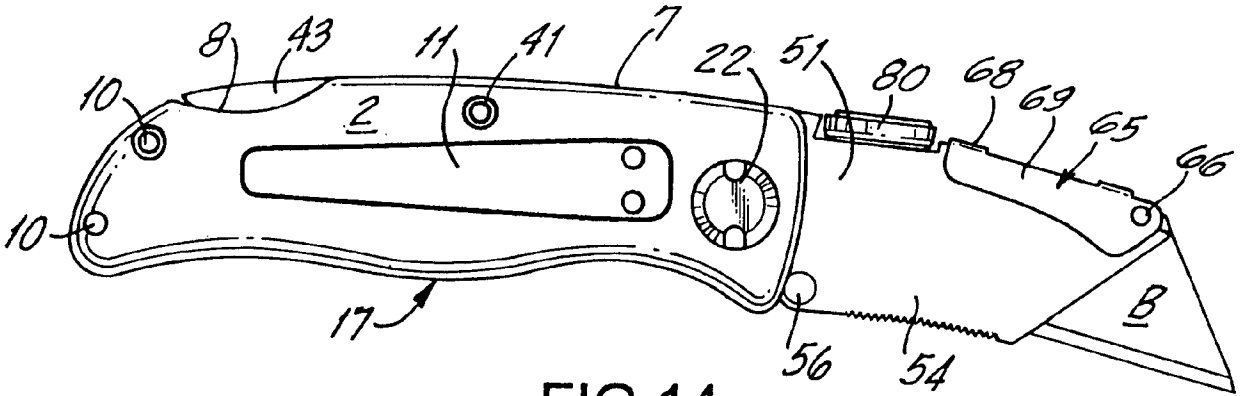
FIG. 14 is a plan view of the opposite side of the utility knife.

A blade lock assembly 65 is mounted along the upper edge 51C of the blade holder 3 and is pivotally mounted to the front end 52 of the blade holder 3 by means of pivot pin 66. The blade lock assembly 65 is in the form of a u-shaped clip and comprises a segmented or interrupted top wall 68, a pair of side walls 69 depending from the top wall 68 and a side finger tab 70 extending outwardly therefrom. When the blade lock assembly or clip 65 is pivoted downwardly around pivot 66, its side walls 69 straddle the walls 54 and 55 of the blade holder 3 and its top wall 68 overlies the walls 54 and 55 as well as the blade B in order to lock the blade B in place. Inwardly extending pimples 71 may be provided in the side walls 69 to frictionally engage the main and guard walls 54–55 to hold the lock assembly 65 in place. When it is desired to remove and replace the blade B, the clip 65 is pivoted upwardly by means of its finger tab 70 to release the walls 54–55 and the blade B. This permits the guard wall 55 to be pivoted relative to main wall 54 away from the blade B (as shown in FIG. 13) in order to expose the blade B and permit the blade B to be removed and replaced.

Figure 5:
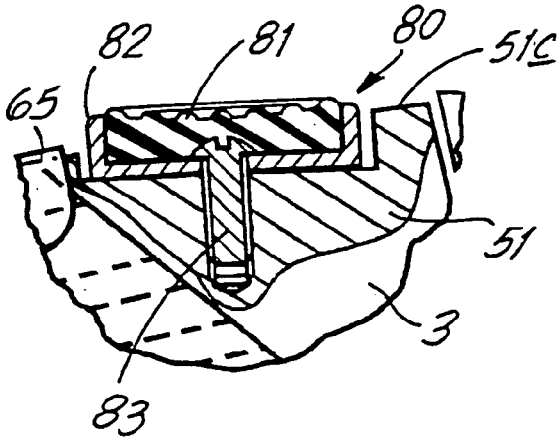
FIG. 5 is a sectional view taken along line 5—5 of FIG. 3.
Figure 6:
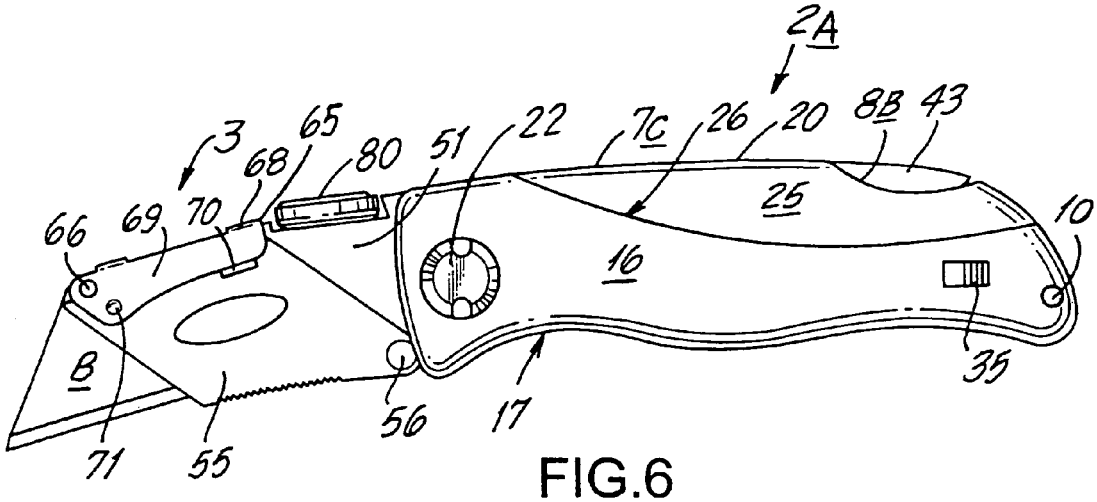
FIG. 6 is a side elevational view of the present invention showing the blade storage component in a closed position.
Figure 7:
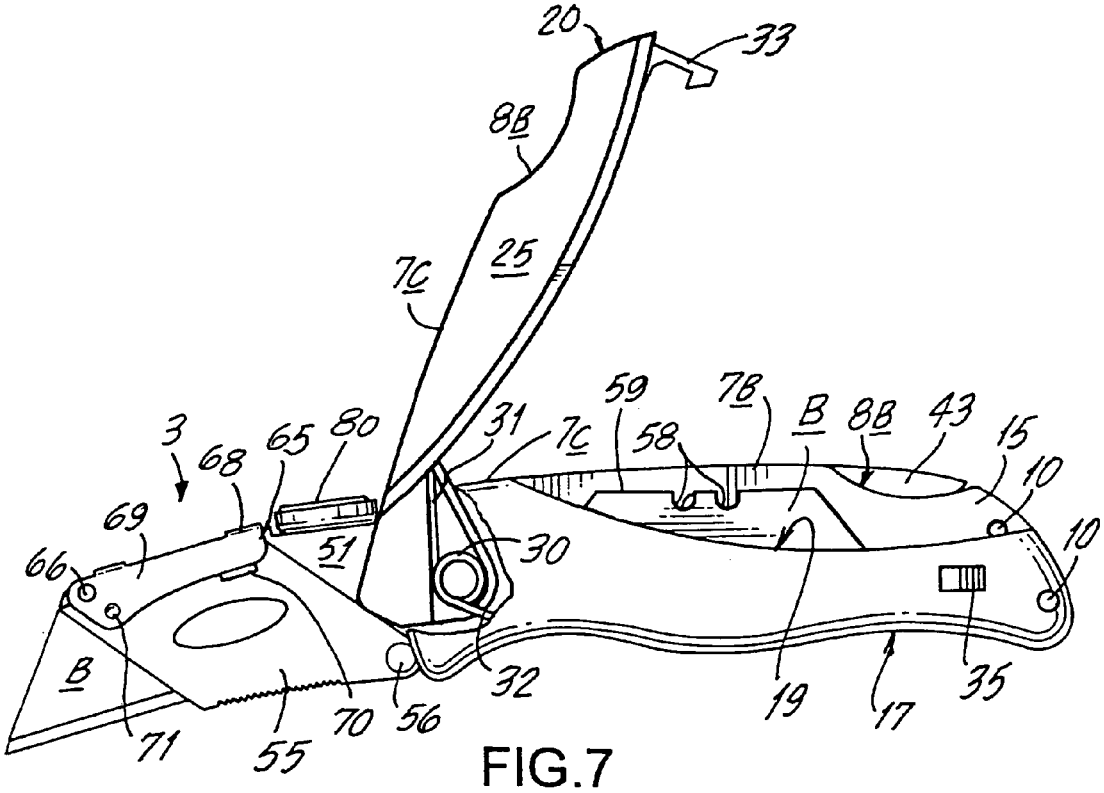
FIG. 7 is a view similar to FIG. 6 showing the blade storage compartment in an open position.

A finger support assembly 80 (FIG. 5) is mounted on the upper edges 51C of the blade holder 3 and comprises a preferably round soft finger pad 81 mounted within a platform 82 and has a downwardly extending stem 83 which is mounted within the upper edge 51C rear portion 51A of the blade holder 3. This finger support assembly 80 permits the user to bear down on the blade holder 3 with his finger without any danger of being injured.

In operation, the utility knife 1 is placed in its operative unfolded position with the blade holder 3 unfolded and ready to be used. The blade B is held on the main wall 54 of the blade holder 3 by protrusions 60 extending into notches 58 in the top edge 59 of the blade B. The lock finger 44 of the front arm 42 of the lock lever assembly 40 is in its lower position (because of the pressure of spring 45 on rear arm 43) and is positioned in the groove 53 in the blade holder 3 in order to hold the blade holder 3 in its unfolded position. The rear arm 43 of the lock lever assembly 40 is in its raised position and protrudes above the finger notch 8 at the top edge 7 of the handle 2A.

Figure 11:
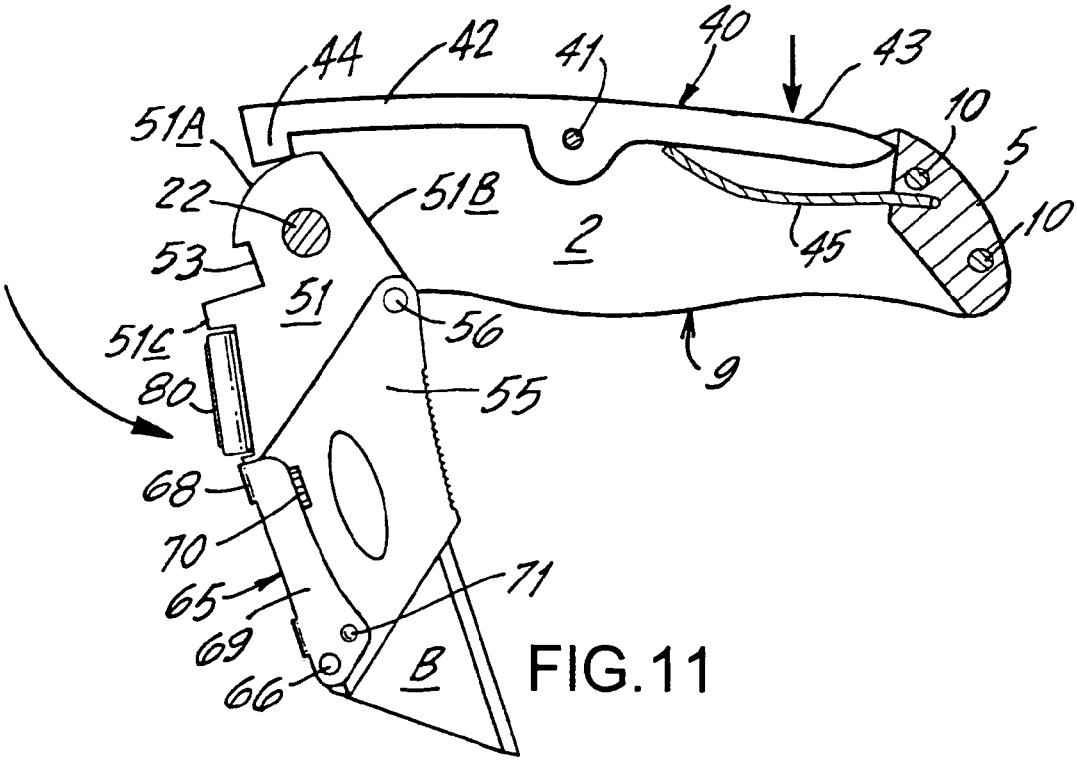
FIG. 11 is a sectional view taken along line 11—11 of FIG. 3 showing the utility knife in a partially folded position.
Figure 12:
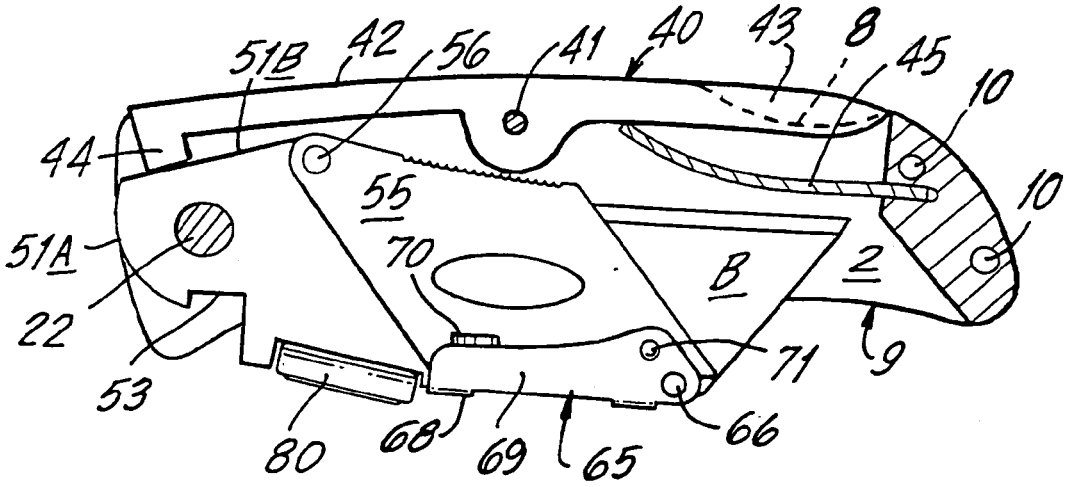
FIG. 12 is a sectional view similar to FIG. 11 showing the utility knife in a fully folded position.

When it is desired to place the utility knife 1 into its folded inoperative position, the rear arm 43 of the lock lever assembly 40 is pressed down manually at the notches 8, 8A and 8B against the bias of the spring 45. This causes the front arm 42 of the lock assembly 40 to be raised thereby moving the lock finger 44 out of the groove 53 to release the blade holder 3 and permit it to pivot downwardly around the pivot pin 22 (FIG. 11). If desired, this may be accomplished by pushing down on the finger support assembly 80. The blade holder 3 is then pivoted down completely and is moved into the space 6 between the side wall 2 and the inner wall 15 (FIG. 12) When pressure on rear arm 43 of the lock lever assembly 40 is released, the spring 45 moves the rear arm 40 back to its original raised position. This causes the lock finger 44 to bear against the rear edge 51 A and lower edge 51 B of the blade holder 3 (FIG. 12) thereby assisting in holding the blade holder 3 in its folded position.

When it is desired to use the blade B, the reverse procedure is followed. The blade holder 3 is pivoted in the opposite direction (again with the use of finger support assembly 80, if desired). It may be desirable for the rear arm 43 of the lock lever assembly 40 to again be depressed manually at the notches 8, 8A and 8B to assist in unfolding the blade holder 3. The blade holder 3 is continued to be rotated counter-clockwise (as seen in FIG. 11) until the lock finger 44 of the front arm 42 enters into the groove 53 in the rear end 51 of the blade holder 3 in order to hold the blade holder 3 in its extended position.

When it is desired to replace a blade B, the blade holder 3 is placed in its unfolded position (as shown in FIG. 13) and the clip 65 is lifted around pivot 66 by means of finger tab 70 thereby the releasing of guard wall 55 and permitting it to be pivoted downwardly relative to main wall 54 around pivot 56 to expose the blade B. The blade B can then be moved out of the blade holder 3 and a new blade B can be placed therein. The guard wall 55 is again pivoted upwardly back into position over the blade B and the clip 65 is lowered to lock the blade B and the walls 54 and 55 in place. The new blade B can be obtained from stored blades B in the blade storage compartment 4 which is opened by moving the latch 35 away from the hook 33 to permit the cover 20 of the blade storage compartment 4 to spring open under tension of spring 30. A blade B can then be removed from the blade storage compartment 4 and placed in the blade holder 3 as set forth above. The blade storage compartment 4 can then be closed by moving it down against bias of spring 30 until the spring pressed latch 35 enters the hook 33 to hold the cover 20 assembly in its closed position.

It will be seen that the present invention provides a utility knife in which the blade holder may be easily folded into a handle in which improved means are provided for securing the blade on the utility knife, for replacing the blade on the knife which provides a finger rest which has a blade holding compartment and which is simple to use and inexpensive to manufacture and maintain.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A utility knife comprising a handle and a blade holder, said blade holder being pivotally mounted on said handle for movement from an unfolded position to a folded position, said handle having a space adapted to receive at least a portion of said blade holder when the blade holder is in its folded position, said blade holder having means for holding a blade thereon and a finger support mounted on said blade holder, said handle having a side wall, said blade storage compartment comprises a pair of opposed inner and outer walls, a bottom wall and an open top, said inner wall being mounted to said side wall in spaced relation to side wall to create said space, said inner wall and said side wall being substantially equal to each other in length, height and configuration, a cover mounted on said blade storage compartment to overlie and close said open top, said cover being movable relative to said inner wall and to said side wall from a closed position closing the open top to an open position opening the open top.

2. A utility knife as set forth in claim 1 wherein said blade holder has an upper edge and wherein said finger support is mounted on said upper edge.

3. A utility knife as set forth in claim 2 wherein said finger support comprises a finger pad.

4. A utility knife as set forth in claim 3 wherein said finger support comprises a platform and wherein said finger pad is mounted on said platform.

5. A utility knife as set forth in claim 4 wherein said pad has a stem extending downwardly therefrom through said platform and wherein said stem is embedded in the top edge of said blade holder.

6. A utility knife as set fort in claim 5, wherein the blade holding means comprise a main wall and a pair of protrusions on the main wall of the blade holder, said protrusions being adapted to enter corresponding grooves in a blade.

7. A utility knife as set forth in claim 6 wherein said cover is pivotally mounted within said open top.

8. A utility knife as set forth in claim 7 wherein said cover has a depending skirt adapted to mate with said outer wall of the blade storage compartment.

9. A utility knife as set forth in claim 8 wherein hook means are provided on said cover.

10. A utility knife as set forth in claim 9 wherein latch means are provided on said outer wall of the blade storage compartment adapted to cooperate with said hook means to hold the cover in the closed position.

11. A utility knife as set fort in claim 10 wherein a magnet is mounted in said blade storage compartment to hold the blades in place therewithin.

12. A utility knife as set forth in claim 11 wherein said handle has a pivoted lock lever assembly mounted in the said space in the handle and wherein said lock lever assembly has a front arm and a rear arm and a lock finger extending from its front arm.

13. A utility knife as set forth in claim 12 wherein said blade holder has a groove therein adapted to receive said lock finger when the blade holder is in its unfolded position.

14. A utility knife as set forth in claim 13 wherein spring means are mounted beneath the rear arm of the lock lever assembly to bias the rear arm upwardly and to bias the front arm downwardly to permit the lock finger to enter the groove, whereby depressing the rear arm against the tension of the spring means will cause the front arm to rise and the lock finger to move out of the groove permitting the blade holder to pivot relative to the handle from an unfolded position to a folded position into the space in the handle.

15. A utility knife as set forth in claim 14, wherein the side wall, the inner wall of the blade storage compartment and the cover have a notch in the top edges and wherein the rear arm protrudes above the notches whereby depression of the rear arm at the notches permits the front end to be raised upwardly and cause the lock finger to move out of the lock groove.

16. A utility knife as set forth in claim 1, wherein said blade holder comprises a main wall and a guard wall mounted on said main wall and moveable from an open position to a closed position overlying said main wall, said main wall having means to hold a blade thereon whereby a blade is interposed between said main wall and said guard wall when said guard wall is in its closed position.

17. A utility knife as set forth in claim 16 wherein said blade holder comprises a rear end and a front end, said front end comprising said guard wall and said main wall, said rear end being pivotally mounted to said handle and having upper and bottom edges.

18. A utility knife as set forth in claim 17 wherein said guard wall is pivotally mounted to said main wall on a pivot adjacent the bottom edge of said main wall.

19. A utility knife as set forth in claim 18 wherein a blade lock assembly is mounted for pivotal movement relative to said main and guard walls from an open position to a closed position overlying the main wall and the guard wall.

20. A utility knife as set forth in claim 19 wherein said blade lock assembly is pivotally mounted on said front end adjacent to said upper edge.

21. A utility knife as set forth in claim 20 wherein said blade lock assembly comprises a u-shaped clip having a top wall and a pair of side walls and wherein said side walls straddle said main wall and a guard wall when a clip is in its closed position.

22. A utility knife as set forth in claim 21 wherein said rear end has a finger tab extending therefrom.

23. A utility knife comprising a handle and a blade holder, said blade holder being pivotally mounted on said handle for movement from an unfolded position to a folded position, said handle having a space adapted to receive at least a portion of said blade holder when the blade holder is in its folded position, said blade holder having means for holding a blade thereon and said handle having a side wall a blade storage compartment comprising a pair of opposed inner and outer walls and an open top, said inner wall being mounted to said side wall in spaced relation thereto to create said space, said inner wall and said side wall being substantially equal to each other in length, height and configuration, a cover mounted on said blade storage compartment to overlie and close said open top, said cover being moveable relative to said inner wall and to said side wall from a closed position closing the open top to an open position opening the open top.

24. A utility knife as set forth in claim 23 wherein said cover is pivotally mounted within said open top.

25. A utility knife as set forth in claim 24 wherein said cover has a depending skirt adapted to mate with said outer wall of the blade storage compartment.

26. A utility knife as set forth in claim 25 wherein hook means are provided on said cover.

27. A utility knife as set forth in claim 26 wherein latch means are provided on said outer wall adapted to cooperate with said hook to hold the cover in the closed position.

28. A utility knife as set fort in claim 27 wherein a magnet is mounted in said blade storage compartment to hold the blades in place therewithin.

29. A utility knife as set forth in claim 28 wherein said handle has a pivoted lock lever assembly mounted in the said space in the handle and wherein said lock lever assembly has a front arm and a rear arm and a lock finger extending from its front arm.

30. A utility knife as set forth in claim 29 wherein said blade holder has a groove therein adapted to receive said lock finger when the blade holder is in its unfolded position.

31. A utility knife as set forth in claim 30 wherein spring means are mounted beneath the rear arm of the lock lever assembly to bias the rear arm upwardly and to bias the front arm downwardly to permit the lock finger to enter the groove, whereby depressing the rear arm against the tension of the spring means will cause the front arm to rise and the lock finger to move out of the groove permitting the blade holder to pivot relative to the handle from an unfolded position to a folded position into the space in the handle.

32. A utility knife as set forth in claim 31, wherein the side wall, the inner wall of the blade storage compartment and the cover have a notch in the top edges and wherein the rear arm protrudes above the notches whereby depression of the rear arm at the notches permits the front end to be raised upwardly and cause the lock finger to move out of the lock groove.

33. A utility knife as set forth in claim 23 wherein said blade holder comprises a main wall and a guard wall mounted on said main wall and moveable from an open position to a closed position overlying said main wall, said main wall having means to hold a blade thereon whereby a blade is interposed between said main wall and said guard wall when said guard wall is in its closed position.

34. A utility knife as set forth in claim 33 wherein said blade holder comprises a rear end and a front end, said front end comprising said guard wall and said main wall, said rear end being pivotally mounted to said handle and having upper and bottom edges.

35. A utility knife as set forth in claim 34 wherein said guard wall is pivotally mounted to said main wall on a pivot adjacent the bottom edge of said main wall.

36. A utility knife as set forth in claim 35 wherein a blade lock assembly is mounted for pivotal movement relative to said main and guard walls from an open position to a closed position overlying the main wall and the guard wall.

37. A utility knife as set forth in claim 36 wherein said blade lock assembly is pivotally mounted on said front end adjacent to said upper edge.

38. A utility knife as set forth in claim 37 wherein said blade lock assembly comprises a u-shaped clip having a top wall and a pair of side walls and wherein said side walls straddle said main wall and a guard wall when a clip is in its closed position.

39. A utility knife as set forth in claim 38 wherein said rear end has a finger tab extending therefrom.

40. A utility knife as set forth in claim 39, wherein said blade holder comprises a pair of protrusions on the main wall of the blade holder, said protrusions being adapted to enter corresponding grooves in a blade.

* * * * *